US006792632B2

(12) United States Patent
Cohen

(10) Patent No.: US 6,792,632 B2
(45) Date of Patent: Sep. 21, 2004

(54) ADJUSTABLE DUST RUFFLE

(75) Inventor: Albert Cohen, Malibu, CA (US)

(73) Assignee: Veratex, Inc., Panorama City, CA (US)

( * ) Notice: Subject to any disclaimer, the term of this patent is extended or adjusted under 35 U.S.C. 154(b) by 0 days.

(21) Appl. No.: 10/361,048

(22) Filed: Feb. 7, 2003

(65) Prior Publication Data

US 2004/0154102 A1 Aug. 12, 2004

(51) Int. Cl.[7] ..... A47G 9/02
(52) U.S. Cl. ..... 5/493; 5/482; 5/486; 5/496
(58) Field of Search ..... 5/493, 482, 486, 5/496, 498, 499, 923; 24/72.5, 711.3; 248/216.1

(56) References Cited

U.S. PATENT DOCUMENTS

| | | | | | |
|---|---|---|---|---|---|
| 3,330,012 | A | * | 7/1967 | Hart et al. | 24/711.3 |
| 4,796,317 | A | | 1/1989 | Kallman et al. | |
| 4,897,891 | A | | 2/1990 | Kallman et al. | |
| 5,205,003 | A | | 4/1993 | Green | |
| 5,335,383 | A | | 8/1994 | Schwind | |
| 5,621,931 | A | * | 4/1997 | Hamilton | 5/493 |
| 5,704,082 | A | * | 1/1998 | Smith | 5/493 |
| 5,749,110 | A | | 5/1998 | Gamble et al. | |
| 5,946,750 | A | | 9/1999 | Shiu | |
| 6,151,731 | A | | 11/2000 | Saparow | |
| 6,276,009 | B1 | | 8/2001 | Schrougham | |
| 2003/0028965 | A1 | | 2/2003 | Wootten, Jr. et al. | |

* cited by examiner

*Primary Examiner*—Teri Pham Luu
*Assistant Examiner*—Fredrick Conley
(74) *Attorney, Agent, or Firm*—Blackwell Sanders Peper Martin LLP

(57) ABSTRACT

An adjustable dust ruffle system includes three separate panels and a plurality of removable screw pins. A portion of each panel is inserted in between the box spring and the mattress. It is not necessary to remove the mattress from the box springs to install this dust ruffle system. Removable screw pins secure the panels in place and allow adjustment so the hem of the dust ruffle is adjacent the floor.

14 Claims, 3 Drawing Sheets

ADJUSTABLE DUST RUFFLE

BACKGROUND OF INVENTION

The present invention is a dust ruffle system for use on a bed.

DESCRIPTION OF THE PRIOR ART

A conventional bed includes a box spring and mattress. Generally the bed is supported by a bed frame which rests on the floor. In a typical bedroom, the head of the bed abuts a wall and is not seen by people in the bedroom. Therefore, dust ruffles commonly have at least three sides of colorful fabric that can easily be seen by people coming into the bedroom.

Heretofore, the placement of dust ruffles around three sides of a box spring, lying beneath a mattress, normally required the complete removal or displacement of the mattress from the box spring. The dust ruffles of the prior art were affixed to the perimeter of a sheet. This sheet, of a fixed length and width, had to be properly placed over the box spring. Many prior art dust ruffles were only suitable for use with a box spring of a particular length and width. This is because the length and width of the sheet with the dust ruffle had to match the dimensions of the box spring. Even with a properly sized sheet, the placement of the dust ruffle around the box spring was often quite time consuming and tedious. There is a need for a dust ruffle that is easy to install on the bed.

In addition, many prior art dust ruffles had a fixed length of about 14½ inches from the top of the box spring to the hem. This height is often referred to in the industry as "drop". In today's market, a fixed drop is often unsuitable because box springs are no longer produced to a standard height. This sometimes creates an unsightly gap between the floor and the hem of the dust ruffle. There is a need for an easily adjustable dust ruffle so there is no substantial gap between the hem and the floor.

Various U.S. patents have issued on dust ruffles including: U.S. Pat. Nos. 4,897,891; 5,205,003; 5,335,383; 5,621,931; 5,749,110; 6,151,731 and 6,276,009. Other U.S. Pat. No. 5,946,750 has issued on a Separable Expansion Bed Shield Set.

U.S. Pat. No. 4,796,317 is for a Dust Ruffle For a Bed. This patent discloses attachment means 18' and 18" that are embedded in the box spring. A mesh portion of the dust ruffle engages the attachment means.

U.S. Pat. No. 5,704,082 is for an Anchor Pin for Dust Ruffle. The underside of the anchor has an adhesive that secures the anchor to a flat section of the dust ruffle.

SUMMARY OF INVENTION

The dust ruffle system of the present invention includes a left side panel, a right side panel and an end panel, all of which are secured to the box spring with a plurality of removable screw pins. The panels cover three sides of the box spring and the bed frame. The panels may be adjusted up or down so the hem of the ruffle is substantially parallel and adjacent to the floor. In addition, portions of each side panel wrap around the corners of the box spring to improve the visual appearance of the bed. During installation of the present dust ruffle system, it is not necessary to remove the mattress from the box spring to install the panels. To change the present dust ruffle, the screw pins can be easily removed and the panels taken off the bed. No adhesives are required so the screw pins can be easily removed from both the box spring and the dust ruffle. With the screw ping removed, the panels can be easily cleaned and easily replaced or another ruffle can be installed.

DETAILED DESCRIPTION

Figure 1:
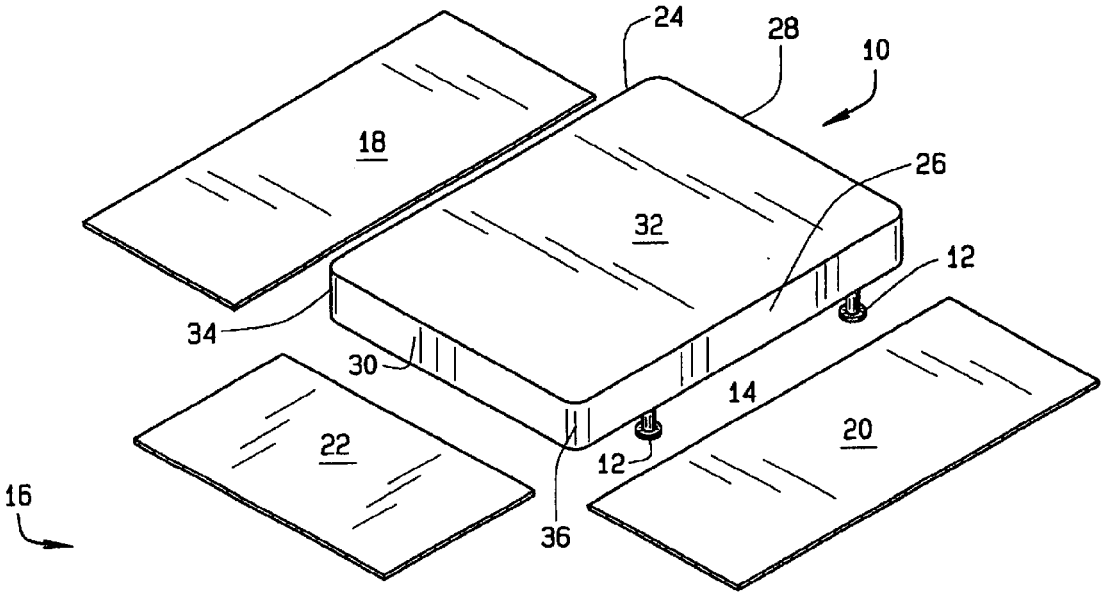
FIG. 1 is a perspective view of a box spring supported on a bed frame and the three panels of the dust ruffle.

The term bed as used herein means a box spring and mattress. Referring to FIG. 1, a box spring 10 is mounted on a bed frame 12 which rests on the floor 14. The mattress has been removed and is not shown in FIG. 1 for clarity. In actual practice, the mattress rests on the box spring and the present dust ruffle is installed between the two.

The present dust ruffle system, generally identified by the numeral 16 includes a left panel 18, a right panel 20 and an end panel 22. These three panels are removeably attached to the box spring 10 by a plurality of removable screw pins, better seen in subsequent figures. The box spring 10 has a left side wall 24, a right side wall 26, a head wall 28 and a foot wall 30. A top 32 joins all the walls, 24, 26, 28 and 30. A left corner 34 is formed at the juncture of the left side wall 24 and the foot wall 30. A right corner 36 is formed at the juncture of the right side wall 26 and the foot wall 30.

Figure 2:
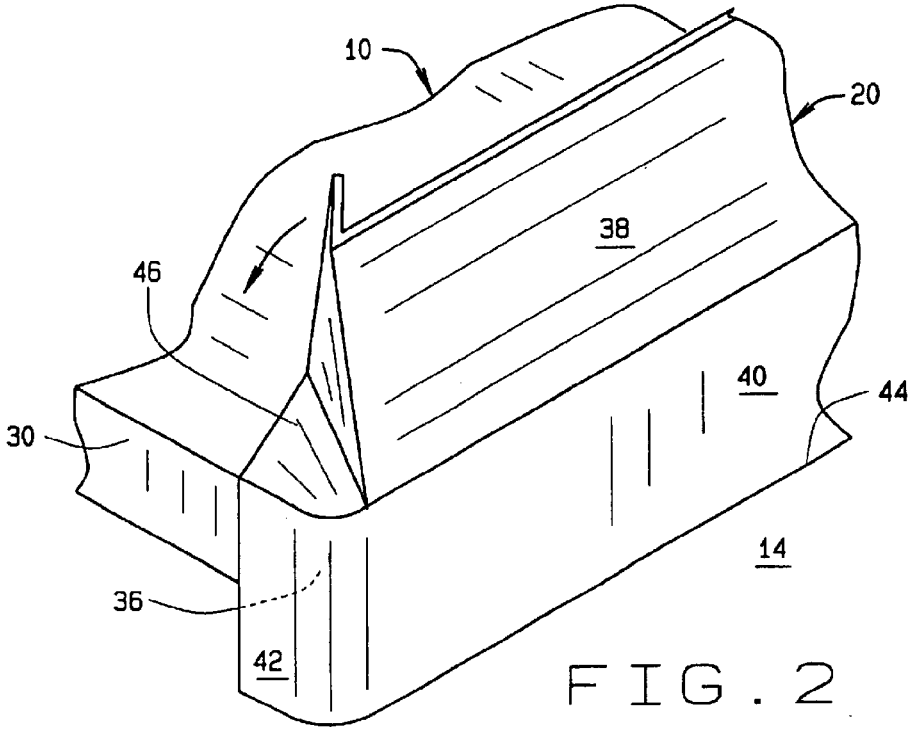
FIG. 2 is an enlargement of the right side panel being wrapped around the right corner of the box spring.

FIG. 2 is an enlargement of the right side panel 20 being wrapped around the right corner 36 of the box spring 10. The right side panel 20 has an insert portion 38, a skirt portion 40 and a corner portion 42. The insert portion 38 slips in between the top 32 of the box spring 10 and the mattress, not shown. The skirt portion 40 hangs down generally parallel to the right side wall 26 of the box spring 10. The hem 44 of the right side panel 20 is adjusted to be substantially parallel and adjacent to the floor 14.

The corner portion 42 of the right side panel 20 is wrapped around the right corner 36 of the box spring 10. The corner portion covers a portion of the foot wall 30 of the box spring 10. A pleat 46 or fold is made in the corner portion and is folded down, as indicated by the arrow, on the top 32 of the box spring 10.

Figure 3:
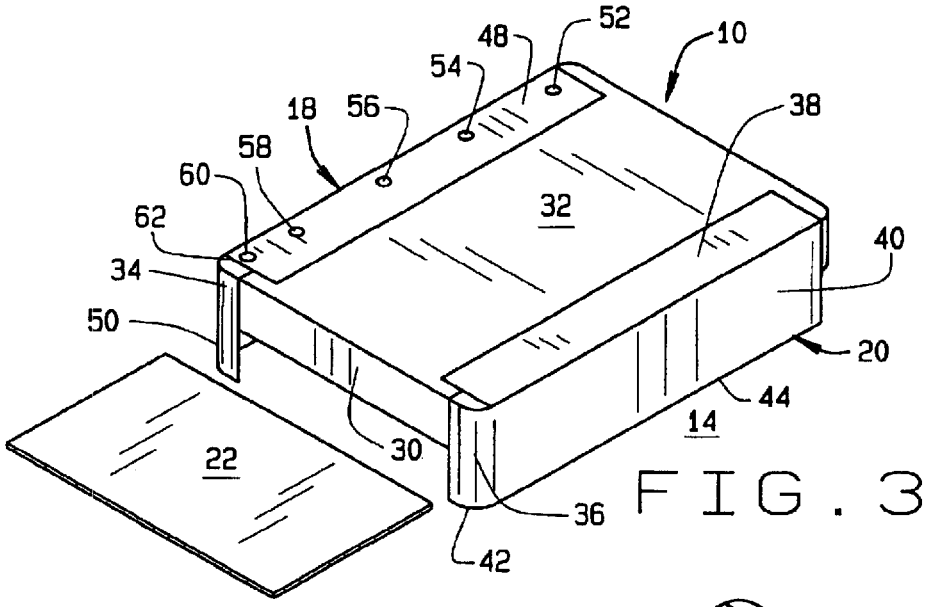
FIG. 3 is a perspective view of the box spring with the left side panel and the right side panel in place and the end panel on the floor.

FIG. 3 is a perspective view of the box spring 10 with the left side panel 18 and the right side panel 20 in place on the box spring. In this figure, the end panel 22 is laying on the floor 14, prior to installation. The insert portion 38 of the right side panel is positioned on the top 32 of the box spring 10. The corner portion 42 of the right side panel 20 wraps around and covers the right corner 36 of the box spring. The right side panel 20 covers the right side wall, the right corner, a portion of the end wall and a portion of the bed frame.

Those skilled in the art will realize that the corner portion 42 of the right side panel could alternatively be placed on the end panel 22. For purposes of claim interpretation, it is equivalent to place the corner portion 42 on either the right side panel 20 or the end panel 22.

The left side panel 18 has an insert portion 48, a skirt portion not shown, and a corner portion 50. The insert portion 48 fits in between the top 32 of the box spring and the mattress. The skirt portion, not shown, hangs down adjacent the left side wall, not shown, of box spring. The corner portion 50 wraps around the corner 34 of the box spring. The skirt portion covers the left side wall of the box spring and a portion of the frame. The corner portion 50 covers the left corner 34 and a portion of the foot wall 30 of the box spring.

Those skilled in the art will realize that the corner portion 50 of the left side panel could alternatively be placed on the end panel 22. For purposes of claim interpretation, it is equivalent to place the corner portion 50 on either the left side panel 18 or the end panel 22.

A plurality of removable screw pins attach the left side panel to the box spring. Removable screw pins 52, 54, 56, and 58 penetrate the insert portion 48 of the left side panel and the top 32 of the box spring. There is no adhesive on the screw pins. Screw pin 60 penetrates a pleat 62 and the top 32 of the box spring.

Figure 4:
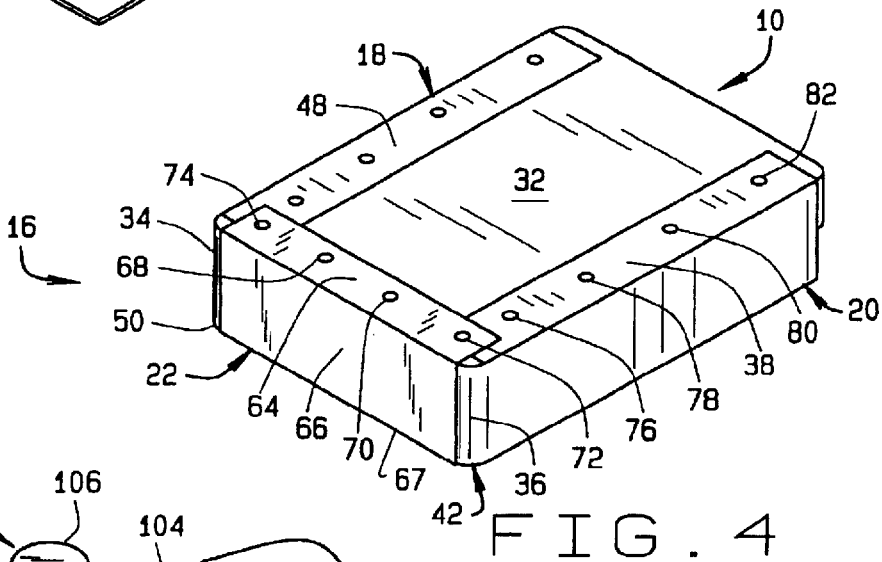
FIG. 4 is a perspective view of the box spring with all three panels in place.

FIG. 4 is a perspective view of the box spring 10 with the dust ruffle system, generally identified by the numeral 16 positioned on the box spring with removable screw pins in place. The end panel 22 has an insert portion 64 that is positioned between the top 32 of the box spring and the mattress, not shown. The end panel 22 also has a skirt portion 66 that hangs adjacent the foot wall 30 of the box spring. The hem 67 of the end panel 22 is adjusted substantially parallel and adjacent to the floor 14. The end panel 22 covers the foot portion 30 of the box spring.

Removable screw pins 68 and 70 penetrate the insert portion 64 of the end panel 22 and the top 32 of the box spring. Removable screw pin 74 penetrates the insert portion 64 of the end pane 22 and the insert portion 48 of the left side panel 18. Removable screw pin 72 penetrates the insert portion 64 of the end panel 22 and the insert portion 38 of the right side panel 20. Removable screw pins 76, 78, 80 and 82 penetrate the insert portion 38 of the right side panel 20 and the top 32 of the box spring.

The left side wall 24, the right side wall 26, the foot wall 30, the left corner 34 and the right corner 36 of the box spring 10 are covered by the dust ruffle system 16. Removable screw pins 52, 54, 56, 58, 60, 68, 70, 72, 74, 76, 78, 80, 82 and 100 hold the three panels in place. The number and placement of the screw pins can vary, provided that a sufficient number are used to hold the panels 18, 20 and 22 in place.

Figure 5:
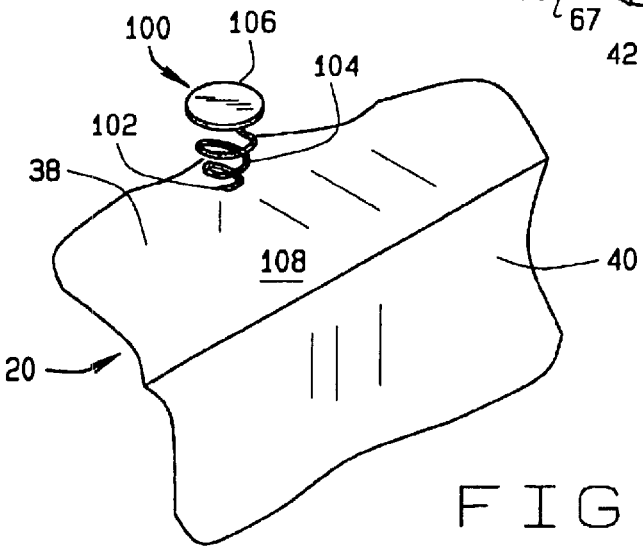
FIG. 5 is an enlargement of a screw pin prior to being inserted through the right side panel.

FIG. 5 is an enlargement of a screw pin, generally identified by the numeral 100, prior to penetrating the insert 38 of the right side panel 20. The screw pin 100 is similar to all the other screw pins previously described above. The screw pin 100 is produced by a number of vendors including The Knobby Crafters of Attleboro, Mass. The screw pin 100 is also sometimes referred to in the trade as twist pins; however, for purposes of this application, they will simply be referred to as screw pins. The screw pin 100 has a sharp point 102 on the end of a spiral shaft 104. The sharp point is capable of penetrating the insert and the top of the box spring. A head 106 is formed at the end opposite the point. The head is large enough to be easily grasped between the fingers and rotated so the spiral shaft bights into the insert and the box spring. As the head is rotated clockwise, the screw pin penetrates through the insert and the box spring and draws the head towards a top surface 108 of the insert 38 of the side panel 20. As the head 106 is rotated counter-clockwise, the screw pin will disengage from the box spring and the insert 38 of the right side panel 20.

Figure 6:
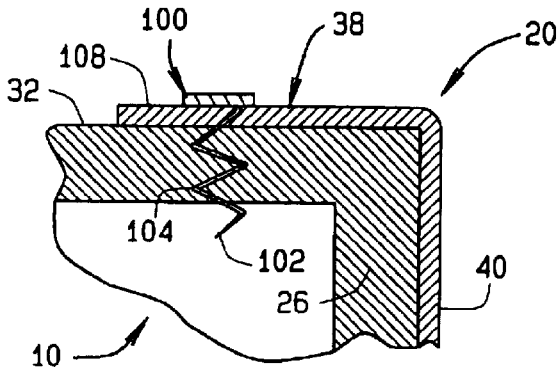
FIG. 6 is an enlargement of the screw pin of FIG. 5 after being inserted through the right side panel into the box spring.

FIG. 6 is an enlargement of the screw pin of FIG. 5 after being inserted through the right side panel into the box spring. The screw pin 100 has been turned clockwise and the sharp point 102 and the spiral shaft 104 have penetrated the insert portion 38 of the right side panel 20. The spiral shaft 104 has also penetrated the top 32 of the box spring 10. The skirt portion 40 of the right side panel hangs substantially parallel to the right side wall 26 of the box spring 10.

Figure 7:
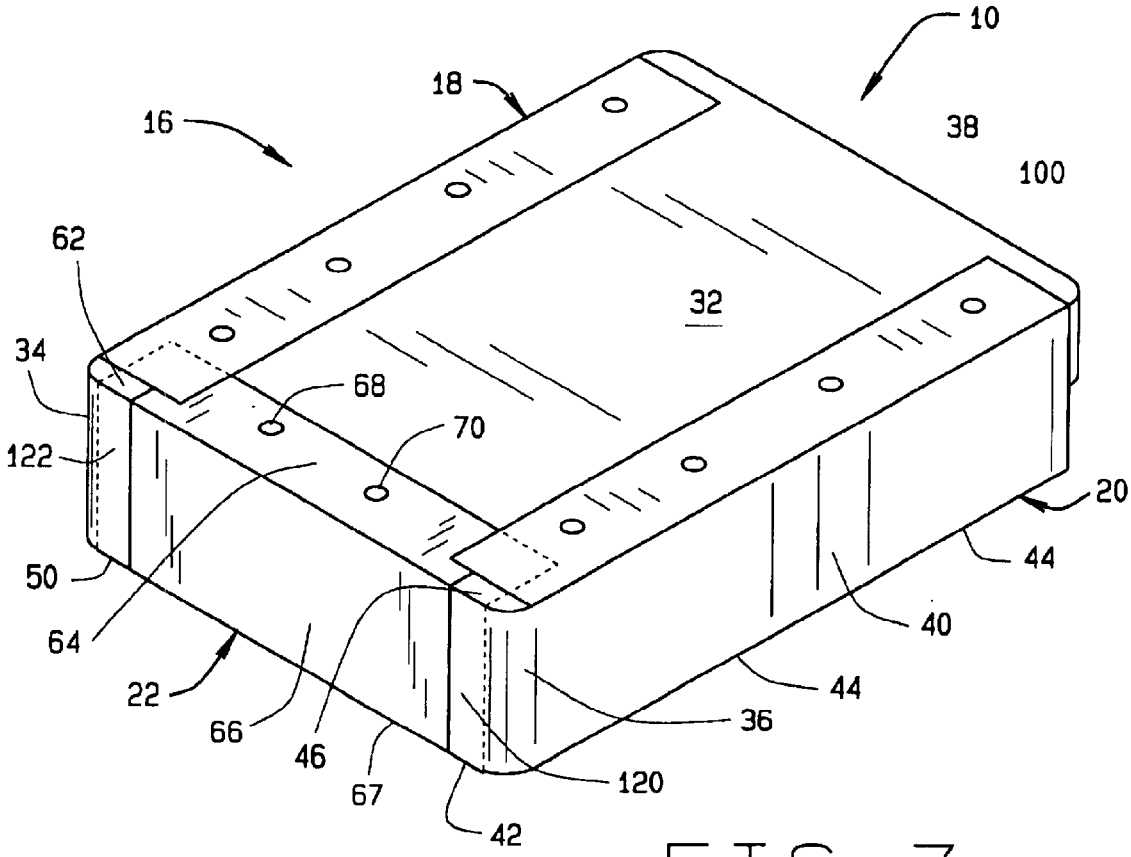
FIG. 7 is a perspective view of the box spring showing an alternative configuration of the three panels in place.

FIG. 7 is a perspective view of the box spring showing an alternative configuration of the three panels in place. The arrangement of the three panels, 18, 20 and 22 is a matter of personal preference. The configuration of the three panels in FIG. 7 requires that the end panel 22 be installed first. In contrast, the configuration to the three panels in FIG. 4 requires that the two side panels 18 and 20 be installed first.

The insert portion 64 of the end panel 22 is slipped in between the top 32 of the box spring 10 and the mattress, not shown. The hem 67 is adjusted substantially parallel and adjacent to the floor. Screw pins 68 and 70 penetrate the insert portion of the end panel and the box spring. Placement of screw pins in the end panel is largely a matter of personal preference, provided that the end panel is held in place on the bed.

The left side panel 18 and the right side panel 20 are then placed on the bed as previously described. Except, the corner portion 42 of the right side panel 20 is wrapped around the right corner 36 of the box spring and a portion of the end panel 22 as shown in phantom. This creates an overlap between the corner portion 42 and a portion 120 of the end panel 22. Likewise, the corner portion 50 of the left side panel 18 is wrapped around the left corner 34 of the box spring and a portion of the end panel 22 as shown in phantom. This creates on overlap between the corner portion 50 and a portion 122 of the end panel 22. A pleat 46 is formed in the right side panel 20. Likewise a pleat 62 is formed in the left side panel 18. The hems of the side panels are adjusted substantially parallel and adjacent to the floor. Screw pins are then inserted as previously discussed.

The end panel 22 covers the foot wall 30 of the box spring 10. The right side panel 22 covers the right side wall 26 and the right corner 36 of the box spring and a portion 120 of the end panel 22. The left side panel 18 covers the left side wall 24 and the left corner 34 of the box spring and a portion 122 of the end panel 22.

Installation of the Dust Ruffle

The three panels can be installed in any order. To install the dust ruffle system 16 as shown in FIG. 4, the left side panel 18 and the right side panel 20 are installed before the end panel 22. To install the dust ruffle system 16 as shown in FIG. 7, the end panel 22 is installed before the left side panel 18 and the right side panel 20. If the owner desired a hybrid of these two configurations could also be installed. Again, the order in which the three panels are installed is a matter of owner preference.

To install the configuration shown in FIG. 4, the insert portions of the left side panel 18 and the right side panel 20 should be slipped in between the top 32 of the box spring and the mattress. It is not necessary to remove the mattress to install the present dust ruffle system. The insert portions of each side panel should be adjusted so the hems of the side panels are substantially parallel and adjacent the floor. Each corner portion should be wrapped around the respective corner of the box spring and a pleat should be folded at the end of each side panels. Removable screw pins can then be inserted through the insert portions of the left side panel and the right side panel into the top of the box spring to hold the panels in place. One or more pins can be inserted into each panel at the pleat to hold the corner portions in place. The left side panel covers the left side wall of the box spring, the left corner, a portion of the foot wall and a portion of the bed frame. The right side panel covers the right side wall of the box spring, the right corner, a portion of the foot wall and a portion of the bed frame.

The insert portion of the end panel 22 can then be slipped in between the top of the box spring and the mattress. The end panel should be adjusted so the hem is substantially parallel and adjacent the floor. Removable screw pins can then be inserted through the insert portion of the end panel and the top of the box spring to hold the end panel in place. One or more pins can be inserted through both the end panel and the left panel. One or more screw pins can also be inserted through both the end panel and the right panel. The end panel covers the foot wall of the box spring and a portion of the bed frame.

To install the configuration shown in FIG. 7, the insert portion 64 of the end panel 22 is slipped in between the top of the box spring and the mattress. The end panel should be adjusted so the hem 67 is substantially parallel and adjacent the floor. Removable screw pins can then be inserted through the insert portion of the end panel and the top of the box spring to hold the end panel in place. The end panel covers the foot wall of the box spring.

The insert portions of the left side panel 18 and the right side panel 20 should be slipped in between the top 32 of the box spring and the mattress. It is not necessary to remove the mattress to install the present dust ruffle system. The insert portions of each side panel should be adjusted so the hems of the side panels are substantially parallel and adjacent the floor. Each corner portion should be wrapped around the respective corner of the box spring and a portion of the end panel 22. A pleat should then be folded at the end of each side panels. Removable screw pins can then be inserted through the insert portions of the left side panel and the right side panel into the top of the box spring to hold the panels in place. One or more pins can be inserted into each panel at the pleat to hold the corner portions in place. Some screw pins may be used to penetrate both the insert portion of the side panels and the insert portion if the end panel and/or the pleat. The left side panel covers the left side wall of the box spring, the left corner, a portion of the end panel and a portion of the bed frame. The right side panel covers the right side wall of the box spring, the right corner, a portion of the end panel and a portion of the bed frame.

To change the dust ruffle system 16, all screw pins must first be removed. Because there are no adhesives, this is a simple task. The three panels can then be pulled out of the bed and they can be cleaned and replaced or another dust ruffle can be installed.

What is claimed is:

1. An adjustable dust ruffle for a bed having a box spring and mattress, the box spring having a left side wall, a right side wall, a head wall and a foot wall, the dust ruffle comprising:

a left side panel having an insert portion, a skirt portion and a corner portion, the insert portion positioned between the box spring and mattress, the skirt portion positioned adjacent the left side wall of the box spring, and the left side panel substantially covering the left side wall of the box spring;

a right side panel having an insert portion, a skirt portion and a corner portion, the insert portion positioned between the box spring and mattress, the skirt portion positioned adjacent the right side wall of the box spring, and the right side panel substantially covering the right side wall of the box spring;

an end panel having an insert portion and a skirt portion, the insert portion positioned between the box spring and mattress, the skirt portion positioned adjacent the foot wall of the box spring, the end panel covering the foot wall of the box spring; and a plurality of removable adhesive free screw pins, some removable screw pins penetrating the insert portion of the left side panel and a portion of the box spring, some removable screw pins penetrating the insert portion of the right side panel and a portion of the box spring, and some removable screw pins penetrating the insert portion of the end panel and a portion of the box spring.

2. The apparatus of claim 1 further including at least one screw pin penetrating the insert portion of the left side panel, the insert portion of the end panel and a portion of the box spring and at least one screw pin penetrating both the insert portion of the right panel, the insert portion of the end panel and a portion of the box spring.

3. The apparatus of claim 1 wherein the left side panel has a hem that is adjusted substantially parallel and adjacent to the floor, the right side panel has a hem that is adjusted substantially parallel and adjacent to the floor and the end panel has a hem that is adjusted substantially parallel and adjacent to the floor.

4. An adjustable dust ruffle for a bed having a box spring and mattress, the box spring having a left side wall, a right side wall, a head wall and foot wall, the juncture of the left side wall and the foot wall defining a left corner and the juncture of the right side wall and the foot wall defining a right corner, the dust ruffle comprising:

a left side panel having an insert portion, a skirt portion and a corner portion, the insert portion positioned between the box spring and mattress, the skirt portion hanging substantially vertically along the left side wall of the box spring, and the corner portion wrapping around the left corner of the box spring, the left side panel substantially covering the left side wall and the left corner of the box spring;

a right side panel having an insert portion, a skirt portion and a corner portion, the insert portion positioned between the box spring and mattress, the skirt portion hanging substantially vertically along the right side wall of the box spring, and the corner portion wrapping around the right corner of the box spring, the right side panel substantially covering the right side wall and the right corner of the box spring;

an end panel having an insert portion and a skirt portion, the insert portion positioned between the box spring and mattress, the skirt portion hanging substantially vertically along the foot wall of the box spring, the end panel substantially covering the foot wall of the box spring; and a plurality of removable adhesive free screw pins, some removable screw pins penetrating the insert portion of the left side panel and a portion of the box spring, some removable screw pins penetrating the insert portion of the right side panel and a portion of the box spring, and some removable screw pins penetrating the insert portion of the end panel and a portion of the box spring.

5. The apparatus of claim 4 further including at least one screw pin penetrating the insert portion of the left side panel, the insert portion of the end panel and a portion of the box spring and at least one screw pin penetrating the insert portion of the right panel, the insert portion of the end panel and a portion of the box spring.

6. The apparatus of claim 4 wherein the left side panel has a hem that is adjusted substantially parallel and adjacent to the floor, the right side panel has a hem that is adjusted substantially parallel and adjacent to the floor and the end panel has a hem that is adjusted substantially parallel and adjacent to the floor.

7. An adjustable dust ruffle for a bed having a box spring and mattress, the box spring having a top joining a left side wall, a right side wall, a head wall and foot wall, the juncture of the left side wall and the foot wall defining a left corner and the juncture of the right side wall and the foot wall defining a right corner, the dust ruffle comprising:

a rectangular shaped first side panel having an insert portion, a skirt portion and a corner portion, the insert portion positioned between the box spring and mattress, the skirt portion hanging substantially vertically along the left side wall of the box spring, and the corner portion wrapping around the left corner of the box spring, the first side panel substantially covering the left side wall and the left corner of the box spring;

a rectangular shaped second side panel having an insert portion, a skirt portion and a corner portion, the insert portion positioned between the box spring and mattress, the skirt portion hanging substantially vertically along the right side wall of the box spring, and the corner portion wrapping around the right corner of the box spring, the second side panel substantially covering the right side wall and the right corner the box spring;

a rectangular shaped end panel having an insert portion and a skirt portion, the insert portion positioned between the box spring and mattress, the skirt portion hanging substantially vertically along the foot wall of the box spring, the end panel substantially covering the foot wall of the box spring; and a plurality of removable adhesive free screw pins, some removable screw pins penetrating the insert portion of the first side panel and the top of the box spring, some removable screw pins penetrating the insert portion of the second side panel and the top of the box spring, and some removable screw pins penetrating the insert portion of the end panel and the top of the box spring.

8. The apparatus of claim 7 further including at least one screw pin penetrating the insert portion of the first side panel, the insert portion of the end panel and a portion of the box spring and at least one screw pin penetrating the insert portion of the second panel, the insert portion of the end panel and a portion of the box spring.

9. The apparatus of claim 7 wherein the first side panel has a hem that is adjusted substantially parallel and adjacent to the floor, the second side panel has a hem that is adjusted substantially parallel and adjacent to the floor and the end panel has a hem that is adjusted substantially parallel and adjacent to the floor.

10. An dust ruffle for a bed having a box spring and mattress, the box spring having a top joining a left side wall, a right side wall, a head wall and foot wall, the juncture of the left side wall and the foot wall defining a left corner and the juncture of the right side wall and the foot wall defining a right corner, the bed resting on a bed frame which sits on a generally horizontal floor, the dust ruffle comprising:

a first side panel having an insert portion, a skirt portion and a corner portion, the insert portion positioned between the top of the box spring and mattress, the skirt portion hanging adjacent the left side wall of the box spring, and the corner portion wrapped around the left corner of the box spring and a portion of an end panel, the first side panel covering substantially the left side wall of the box spring and a portion of the end panel;

a second side panel having an insert portion, a skirt portion and a corner portion, the insert portion positioned between the top of the box spring and mattress, the skirt portion hanging adjacent the right side wall of the box spring, and the corner portion wrapped around the right corner of the box spring and a portion of the end panel, the second side panel covering substantially the right side wall of the box spring and a portion of the end panel;

the end panel having an insert portion and a skirt portion, the insert portion positioned between the top of the box spring and mattress, the skirt portion hanging adjacent the foot wall of the box spring, the end panel covering substantially the foot wall of the box spring; and a plurality of removable adhesive free screw pins, some removable screw pins penetrating the insert portion of the first side panel and the top of the box spring, some removable screw pins penetrating the insert portion of the second side panel and the top of the box spring, and some removable screw pins penetrating the insert portion of the end panel and the top of the box spring.

11. The apparatus of claim 10 further including at least one screw pin penetrating the insert portion of the first side panel, the insert portion of the end panel and the top of the box spring and at least one screw pin penetrating the insert portion of the second panel, the insert portion of the end panel and the top of the box spring.

12. The apparats of claim 10 wherein the first side panel has a hem that is adjusted substantially parallel and adjacent to the floor, the second side panel has a hem that is adjusted substantially parallel and adjacent to the floor and the end panel has a hem that is adjusted substantially parallel and adjacent to the floor.

13. A method for installing a dust ruffle on a bed which rests on a bed frame which sits on a generally horizontal floor, the bed having a box spring and mattress, the box spring having a top joining a left side wall, a right side wall, a head wall and foot wall, the juncture of the left side wall and the foot wall defining a left corner and the juncture of the right side wall and the foot wall defining a right corner, the method of installation comprising:

placing an insert portion of a side panel in between the top of the box spring and the mattress adjacent the left side wall of the box spring;

wrapping a corner portion of the first side panel around the left corner of the box spring and a portion of the foot wall;

adjusting a hem of the first side panel to be substantially parallel and adjacent the floor so the first side panel covers the left side wall and the left corner of the box spring and a portion of the frame;

inserting a plurality of removable adhesive free screw pins through the insert portion of the first side panel and the top of the box spring;

placing an insert portion of a second side panel in between the top of the box spring and the mattress adjacent the right side wall of the box spring;

wrapping a corner portion of the second side panel around the right corner of the box spring and a portion of the foot wall;

adjusting a hem of the second side panel to be substantially parallel and adjacent the floor so the second side panel covers the right side wall and the right corner of the box springs and a portion of the bed frame;

inserting a plurality of removable adhesive free screw pins through the insert portion of the second side panel and the top of the box spring;

placing an insert portion of an end panel in between the top of the box spring and the mattress adjacent the foot wall of the box spring;

adjusting a hem of the end panel to be substantially parallel and adjacent the floor so the end panel covers the end wall of the box springs and a portion of the frame; and inserting a plurality of removable screw pins through the insert portion of the end panel and the top of the box spring.

14. A method for installing a dust ruffle on a bed which rests on a bed frame which sits on a generally horizontal floor, the bed having a box spring and mattress, the box spring having a top joining a left side wall, a right side wall, a head wall and foot wall, the juncture of the left side wall and the foot wall defining a left corner and the juncture of the right side wall and the foot wall defining a right corner, the method of installation comprising:

placing an insert portion of an end panel in between the top of the box spring and the mattress adjacent the foot wall of the box spring;

adjusting a hem of the end panel to be substantially parallel and adjacent the floor so the end panel covers the end wall of the box spring and a portion of the frame; and inserting a plurality of removable screw pins through the insert portion of the end panel and the top of the box spring;

placing an insert portion of a first side panel in between the top of the box spring and the mattress adjacent the left side wall of the box spring;

wrapping a corner portion of the first side panel around the left corner of the box spring and a portion of the end panel;

folding a pleat in the first side panel proximate the left corner of the box spring;

adjusting a hem of the first side panel to be substantially parallel and adjacent the floor so the first side panel covers the left side wall and the left corner of the box spring and a portion of the frame;

inserting a plurality of removable screw pins through the insert portion of the first side panel and the top of the box spring;

placing an insert portion of a second side panel in between the top of the box spring and the mattress adjacent the right side wall of the box spring;

wrapping a corner portion of the second side panel around the right corner of the box spring and a portion of the end panel;

folding a pleat in the second side panel proximate the right corner of the box spring;

adjusting a hem of the second side panel to be substantially parallel and adjacent the floor so the second side panel covers the right side wall and the right corner of the box springs and a portion of the bed frame;

inserting a plurality of removable screw pins through the insert portion of the second side panel and the top of the box spring.

* * * * *

UNITED STATES PATENT AND TRADEMARK OFFICE

CERTIFICATE OF CORRECTION

PATENT NO. : 6,792,632 B2
DATED : September 21, 2004
INVENTOR(S) : Albert Cohen

It is certified that error appears in the above-identified patent and that said Letters Patent is hereby corrected as shown below:

Column 3,
Line 40, delete “pane” and replace with -- panel --;

Column 8,
Line 36, delete “apparats” and replace with -- apparatus --; and
Line 50, prior to the phrase “side panel” insert -- first --.

Signed and Sealed this

Fifteenth Day of February, 2005

JON W. DUDAS
*Director of the United States Patent and Trademark Office*